US009383687B2

(12) United States Patent
Nedelin et al.

(10) Patent No.: US 9,383,687 B2
(45) Date of Patent: Jul. 5, 2016

(54) TRANSFER OF INK LAYERS

(75) Inventors: Peter Nedelin, Ashdod (IL); Mark Sandler, Rehovot (IL); Shai Lior, Rehovot (IL)

(73) Assignee: Hewlett-Packard Indigo B.V., Maastricht (NL)

( * ) Notice: Subject to any disclaimer, the term of this patent is extended or adjusted under 35 U.S.C. 154(b) by 0 days.

(21) Appl. No.: 14/362,872

(22) PCT Filed: Dec. 21, 2011

(86) PCT No.: PCT/EP2011/073611

§ 371 (c)(1),
(2), (4) Date: Jun. 4, 2014

(87) PCT Pub. No.: WO2013/091690

PCT Pub. Date: Jun. 27, 2013

(65) Prior Publication Data

US 2014/0308055 A1 Oct. 16, 2014

(51) Int. Cl.

| | |
|---|---|
| ***G03G 15/01*** | (2006.01) |
| ***G03G 15/10*** | (2006.01) |
| ***G03G 15/16*** | (2006.01) |
| ***G03G 13/10*** | (2006.01) |

(52) U.S. Cl.

CPC ..... *G03G 15/10* (2013.01); *G03G 13/10* (2013.01); *G03G 15/0152* (2013.01); *G03G 15/0168* (2013.01); *G03G 15/1605* (2013.01); *G03G 2215/0626* (2013.01)

(58) Field of Classification Search

USPC ..... 347/118

See application file for complete search history.

(56) References Cited

U.S. PATENT DOCUMENTS

| | | | | |
|---|---|---|---|---|
| 7,027,746 | B2 | 4/2006 | Suzuki et al. | |
| 8,011,841 | B2 | 9/2011 | Ihara et al. | |
| 2002/0051211 | A1 | 5/2002 | Takahashi et al. | |
| 2003/0223781 | A1 * | 12/2003 | Grenek et al. | 399/223 |
| 2005/0239918 | A1 * | 10/2005 | Nakazawa et al. | 523/160 |
| 2008/0218540 | A1 | 9/2008 | Iftime et al. | |
| 2009/0180788 | A1 * | 7/2009 | Tamoto | G03G 5/043 399/48 |
| 2011/0148970 | A1 | 6/2011 | Tsuboi et al. | |

FOREIGN PATENT DOCUMENTS

| | | |
|---|---|---|
| EP | 0749050 | 12/1996 |
| JP | 58031369 | 2/1983 |
| JP | 2009000836 A | 1/2009 |
| WO | WO-2007/035562 A2 | 3/2007 |

OTHER PUBLICATIONS

PCT Search Report/Written Opinion—Application No. PCT/EP2011/073611 dated Sep. 12, 2012—11 pages.

* cited by examiner

*Primary Examiner* — David Gray
*Assistant Examiner* — Sevan A Aydin

(57) ABSTRACT

An image forming apparatus includes a photoconductive member to move in a rotational direction, a charging unit to charge the photoconductive member, a discharging unit to discharge a portion of the photoconductive member to form a latent image thereon, and a plurality of ink applicator units to sequentially apply a plurality of ink layers, respectively, toward the latent image to form an ink image. The image forming apparatus may also include an image transfer blanket to receive the ink image including the plurality of ink layers from the photoconductive member.

17 Claims, 7 Drawing Sheets

TRANSFER OF INK LAYERS

BACKGROUND

Image forming apparatuses may include ink applicator units, a charging unit, a discharging unit, a photoconductive member, and an intermediate transfer member having an image transfer blanket. During a print cycle, the image forming apparatus may include charging the photoconductive member, selectively discharging a portion of the photoconductive member to form a latent image thereon, developing an ink layer on the photoconductive member, and transferring the developed ink layer from the photoconductive member to the image transfer blanket in a form of a print separation. During a subsequent print cycle, the process may be repeated resulting in another print separation being transferred from the photoconductive member to the image transfer blanket. After the print cycles are completed resulting in the respective print separations being transferred to the image transfer blanket to form a respective ink image thereon, the ink image is transferred from the image transfer blanket to a media.

BRIEF DESCRIPTION OF THE DRAWINGS

Non-limiting examples of the present disclosure are described in the following description, read with reference to the figures attached hereto and do not limit the scope of the claims. In the figures, identical and similar structures, elements, or parts thereof that appear in more than one figure are generally labeled with the same or similar references in the figures in which they appear. Dimensions of components and features illustrated in the figures are chosen primarily for convenience and clarity of presentation and are not necessarily to scale. Referring to the attached figures:

DETAILED DESCRIPTION

Figure 1:
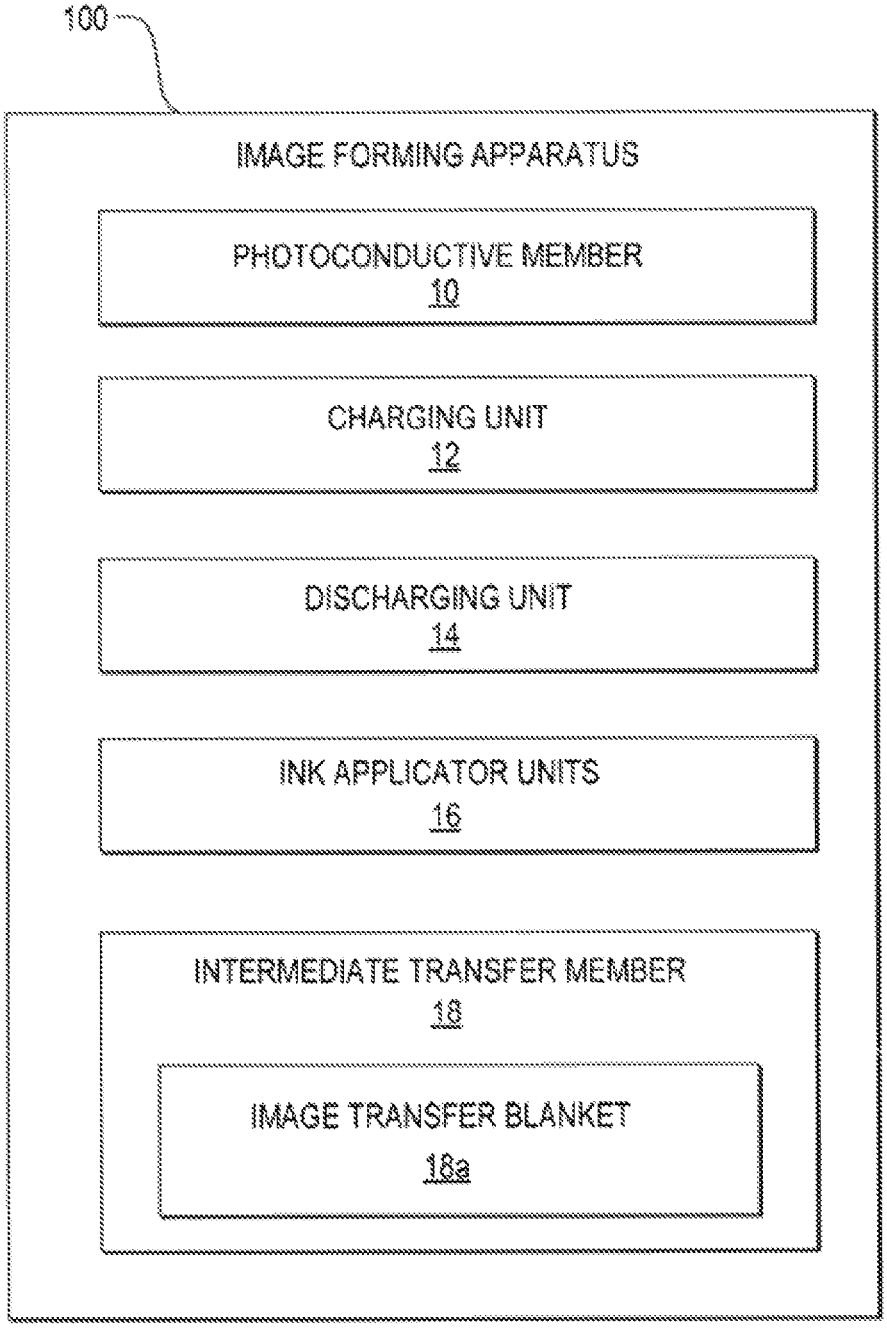
FIG. 1 is a block diagram of an image forming apparatus according to an example.

In the following detailed description, reference is made to the accompanying drawings which form a part hereof, and in which is depicted by way of illustration specific examples in which the present disclosure may be practiced. It is to be understood that other examples may be used and structural or logical changes may be made without departing from the scope of the present disclosure. The following detailed description, therefore, is not to be taken in a limiting sense, and the scope of the present disclosure it defined by the appended claims.

Image forming apparatuses may include ink applicator units such as developer units, a charging unit, a discharging unit, a photoconductive member, and an intermediate transfer member having an image transfer blanket. During a print cycle, the image forming apparatus may charge the photoconductive member, selectively discharge a portion of the photoconductive member to form a latent image thereon, develop an ink layer on the photoconductive member, and transfer the developed ink layer from the photoconductive member to the image transfer blanket in a form of a print separation. During a subsequent print cycle, the process may be repeated resulting in another print separation being transferred from the photoconductive member to the image transfer blanket. After the respective print cycles are completed that result in the respective print separations being transferred to the image transfer blanket to form a respective ink image thereon, the resultant ink image is transferred from the image transfer blanket to a media. The use of an independent print cycle to transfer each ink layer from the photoconductive member to the image transfer blanket may be time consuming and increase wear on the ink transfer blanket. Accordingly, the productivity of the image forming apparatus and the lifespan of the image transfer blanket may decrease.

In examples, an image forming apparatus may include, among other things, a plurality of ink applicator units disposed across from a photo-conductive member and spaced apart from each other in a rotational direction of the photoconductive member. The ink applicator units may sequentially apply a plurality of ink layers, respectively, toward the latent image to form an ink image. Each one of the ink layers may be in contact with another one of the ink layers. The image forming apparatus may also include an intermediate transfer member having an image transfer blanket to receive the ink image including the plurality of ink layers from the photoconductive member. Thus, the formation of the ink image on the photoconductive member by multiple ink layers and the transfer of the ink image to the image transfer blanket may be accomplished in a single print cycle. The use of a single print cycle to sequentially apply each of ink layers to the photoconductive member and to transfer the group of respective ink layers in the form of an ink image to the image transfer blanket may reduce printing time and decrease wear on the ink transfer blanket. Accordingly, the productivity of the image forming apparatus and the lifespan of the image transfer blanket may increase.

Figure 2:
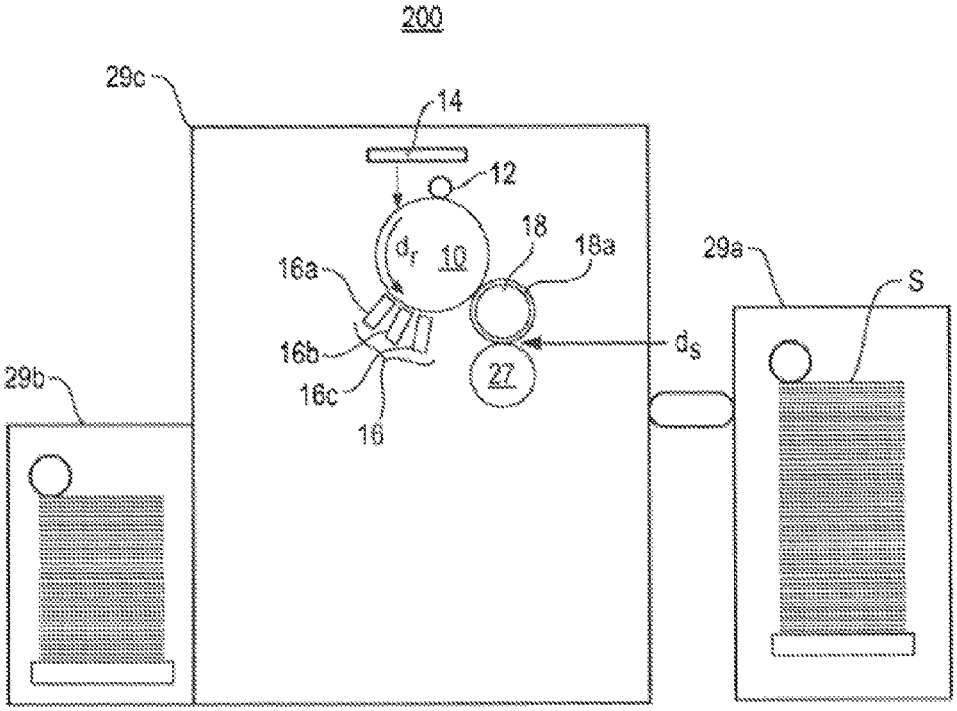
FIG. 2 is a schematic view illustrating an image forming apparatus such as a liquid electrophotography printing system according to an example.

FIG. 1 is a block diagram of an image forming apparatus, according to an example. Referring to FIG. 1, in examples, an image forming apparatus 100 may include a photoconductive member 10, a charging unit 12, a discharging unit 14, a plurality of ink applicator units 16, and an intermediate transfer member 18 having an image transfer blanket 18*a*. The photoconductive member 10 may move in a rotational direction $d_r$ (FIG. 2). The charging unit 12 may charge the photoconductive member 10. For example, the charging unit 12 may be a scorotron, charge roller, or the like, to form a uniform electrical charge on a surface of the photoconductive member 10. The discharging unit 14 may discharge a portion of the photoconductive member 10 to form a latent image thereon. For example, the discharging unit 14 may be a laser, or the like. The discharging unit 14 may form the respective latent image on the photoconductive member 10 based on received image data.

The plurality of ink applicator units 18 may be disposed across from the photoconductive member 10 and spaced apart from each other in the rotational direction $d_r$. The ink applicator units 16 may be inkjet printheads, developer units, binary ink developer units, or the like. The ink applicator units 10 may sequentially apply a plurality of ink layers, respectively, toward the latent image to form an ink image. Each one of the ink layers may be in contact with another one of the ink layers. For example, a first ink layer may be applied on top of the latent image formed on the photoconductive member 10.

A second ink layer may be applied on top of the first ink layer. In some examples, additional ink layers may be applied toward the latent image by being applied to the latent image or to a previously-applied ink layer.

The ink layer applied by the ink applicator units 16 may be in the form of ink. The ink, for example, may include primer to form a primer layer, colored ink to form a colored-ink layer, and ink overcoat to form an ink overcoating layer. The colored ink, for example, may include at least one of cyan, magenta, yellow, white, black, or the like. For example, the colored ink may be a liquid toner such as Electroink, trademarked by Hewlett-Packard Company, including color pigments. In some examples, the ink may include charge directors having an electrical charge. Accordingly, the electrically-charged ink may be selectively applied toward the discharged portion of the photoconductive member 10 forming the latent image based on a sufficient difference of electrical potential there between. The intermediate transfer member 18 may include an image transfer blanket 18*a* to receive the ink image including the plurality of ink layers from the photoconductive member 10. The intermediate transfer member 18 may rotate in cooperation with the photoconductive member 10 to receive the ink image from the photoconductive member 10.

Figure 3:
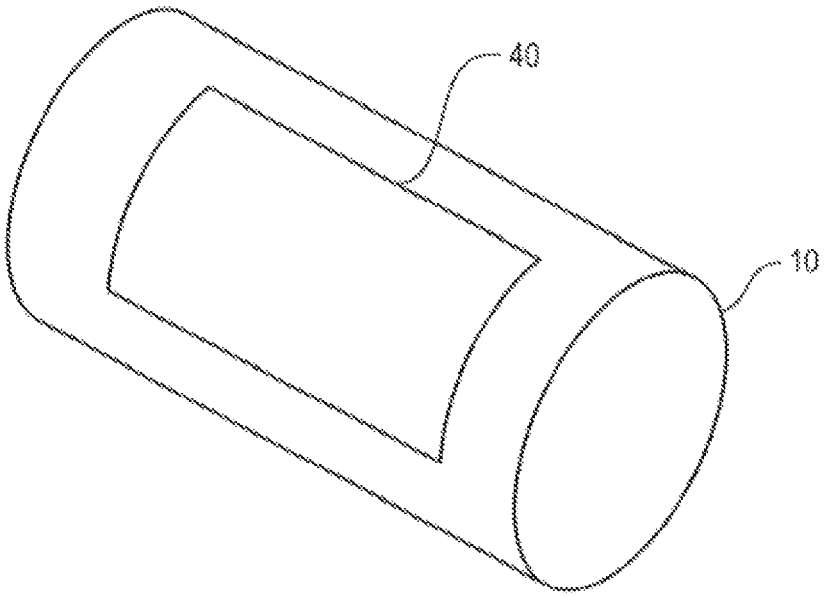
FIG. 3 is a perspective view illustrating a photoconductive member having a latent image formed thereon of the image forming apparatus of FIG. 2 according to an example.
Figure 4A:
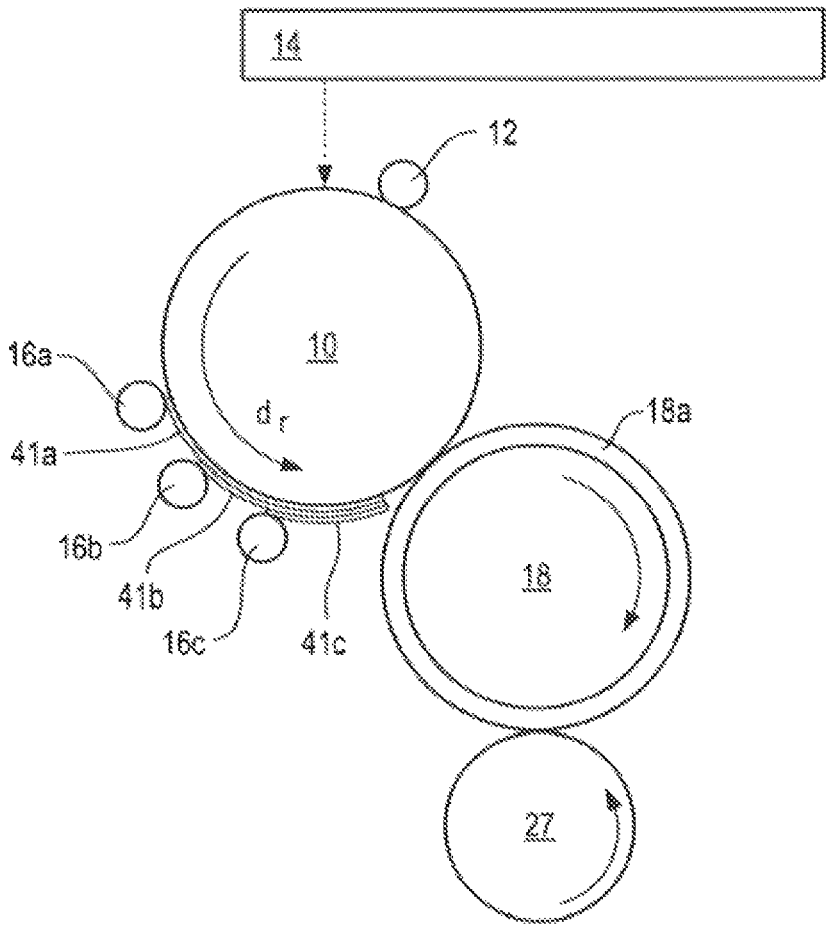
FIGS. 4A-4C are side views illustrating the application and transfer of ink layers within the image forming apparatus of FIG. 2 according to examples.
Figure 4B:
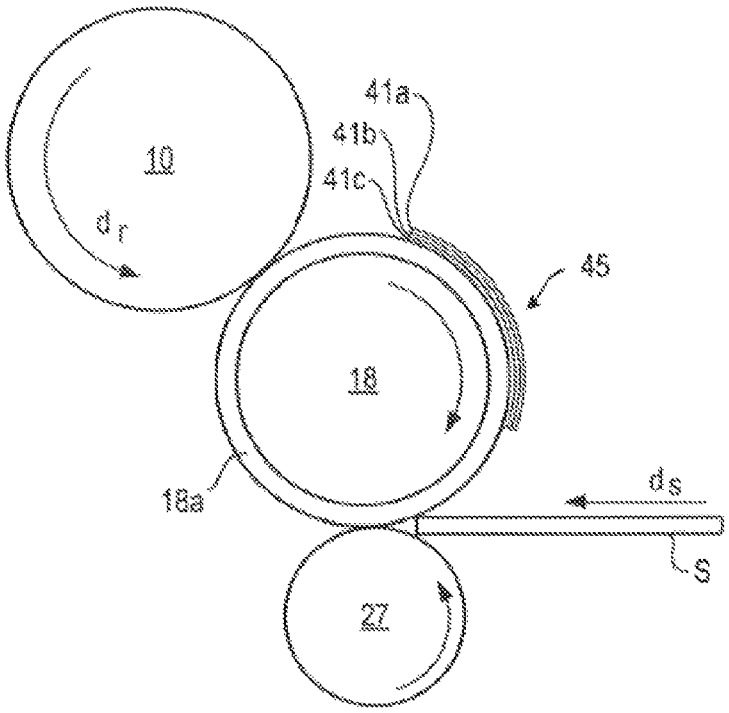
Figure 4C:
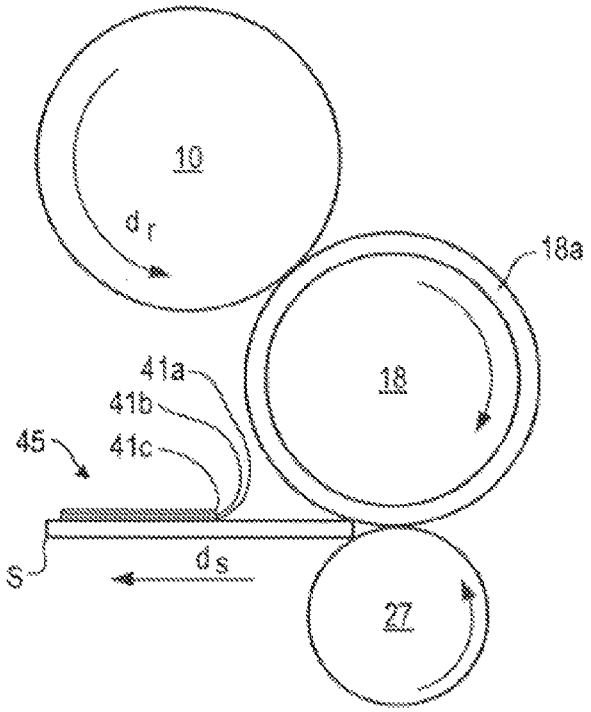

FIG. 2 is a schematic view illustrating an image forming apparatus such as a liquid electrophotography printing (LEP) system according to an example. FIG. 3 is a perspective view illustrating a photoconductive member having a latent image formed thereon of the image forming apparatus of FIG. 2 according to an example. FIGS. 4A-4C are side views illustrating the application and transfer of ink layers within the image forming apparatus of FIG. 2 according to examples. Referring to FIG. 2, the image forming apparatus 200 may include an input unit 29*a*, an output unit 29*b*, and an image forming unit 29*c*. The image forming unit 29*c* may receive a media S from an input unit 29*a* and output the media S to an output unit 28*b*. The media S may be transported in a media transport direction $d_s$. The image forming unit 29*c* may include a photoconductive member 10, a charging unit 12, a discharging unit 14, a plurality of ink applicator units 18, and an intermediate transfer member (ITM) 18 including an image transfer blanket 18*a* as previously disclosed with respect to the image forming apparatus 100 of FIG. 1. In some examples, the image forming unit 29*c* may also include an impression member 27.

Referring to FIGS. 2-4C, in some examples, the charging unit 12 may provide a uniform electrical charge on the photoconductive member 10. The discharging unit 14 may selectively discharge portions of the photoconductive member 10 to form a latent image 40 thereon. That is, the discharging unit 14 may decrease the electrical potential of the discharged portion of the photoconductive member 10 relative to other portions thereof. In some examples, the image forming apparatus 200 may include only a single discharging unit 14 to form a latent image 40 on the photoconductive member 10. The ink applicator units 16 may sequentially apply ink layers 41*a*, 41*b*, and 41*c* (collectively 41), respectively, toward the latent image 40 on the photoconductive member 10 to form an ink image 45. For example, the ink layers 41 may be formed of ink having an electrical charge that is attracted toward the discharged portion of the photoconductive member 10. In some examples, the plurality of ink layers 16 may include a dual ink layer structure. That is, a first ink applicator unit 18*a* may apply a first ink layer 41*a* on the latent image 40. The first ink layer 41*a*, for example, may be a primer layer. For example, a primer layer may increase the adhesiveness of subsequent ink layers such as colored-ink layers to adhere to a surface. Alternatively, the first ink layer 41*a* may be a colored-ink layer having a color such as black, or the like. A second ink applicator unit 16*b*, disposed downstream from the first ink applicator unit 18*a* in the rotational direction $d_r$, may apply a second ink layer 41*b* toward the latent image 40 and on top of the first ink layer 41*a*. The second ink layer 41*b*, for example, may be a colored-ink layer having a color. In some examples, the colored-ink layer of the second ink layer 41*b* may be the same color of the colored ink layer of the first ink layer 41*a*. Alternatively, the second ink layer 41*a* may be an ink coating layer. Thus, the overall thickness of the ink image 48 may be increased by adding onto each other multiple colored ink layers, for example, having the same color. Such an increased thickness may be used, for example, in raised print applications, embossing applications, or the like.

In some examples, the plurality of ink layers 18 may include more than two ink layers 16*a* and 18*b*. For example, a third ink applicator unit 16*c*, disposed downstream from the second ink applicator unit 16*b* in the rotational direction $d_r$, may apply a third ink layer 41*c* toward the latent image 40 and on top of the second ink layer 41*b*. The third ink layer 41*c*, for example, may be an ink overcoating layer. The ink overcoating layer may provide a protective coating to the ink image 45 and/or enhance the appearance of the ink image 45. The ink overcoating layer may include a gloss coating layer, a matte coating layer, or the like. Alternatively, in some examples, the third ink layer 41*c* may be a colored-ink layer having the same color as the second colored-ink layer 41*b*. In some examples, the image forming apparatus 200 may include additional ink applicator units to apply colored-ink layers corresponding to a variety of colors.

Referring to FIGS. 3-4C, the respective ink layers 41*a*, 41*b*, and 41*c* may be sequentially applied toward the latent image 40 to form the ink image 45 on the photoconductive member 10 prior to the transfer of the ink image 45 from the photoconductive member 10 to the image transfer blanket 18*a* of the ITM 18. For example, the discharged portion of the photo-conductive member 10 may continue to attract additional ink layers 41*b* and 41*c* even after receiving at least one previous ink layer 41*a* during the same print cycle. A print cycle, for example, may include the charging of the photoconductive member 10, a discharging of a portion of the photoconductive member 10 to form a latent image 40 thereon, applying at least one ink layer 41*a* on the photoconducting member 40 corresponding to the latent image 40 to form an ink image 45, and transferring the ink image 45 to the image transfer blanket 18*a* from the photoconductive member 10. For example, the respective ink layers 41*a*, 41*b*, and 41*c* from the ink applicator units 18 may be applied toward the latent image 40 on the photoconductive member 10 to form the respective ink image 45 during a single rotation of the photoconductive member 10.

Subsequently, the ink image 45 including multiple ink layers 41*a*, 41*b*, and 41*c* may be transferred to an image transfer blanket 18*a* of an ITM 18. That is, the multiple ink layers 41*a*, 41*b*, and 41*c* previously and sequentially applied as respective individual ink layers to form the ink image 45 on the photoconductive member 10 are transferred simultaneously as a group to the image transfer blanket 18*a*. In the form of the ink image 45. The photoconductive member 10 may sequentially receive the individual ink layers 41*a*, 41*b*, and 41*c* and transfer the multiple ink layers 41*a*, 41*b*, and 41*c* there from to the image transfer blanket 18*a* as a group in the form of the ink image 46 during a single print cycle. Subsequently, the ITM 18 may transfer the ink image 45 from the image transfer blanket 18*a* to a media S. In some examples, the ITM 18 may heat the ink image 45 and transfer it to the media S. During the transfer of the ink image 45 from the ITM 18 to the media S, the media S may be pinched between the ITM 18 and an impression member 27. Once the ink image has been transferred to the media S, the media S can be transported to the output unit 14*b*.

Figure 5:
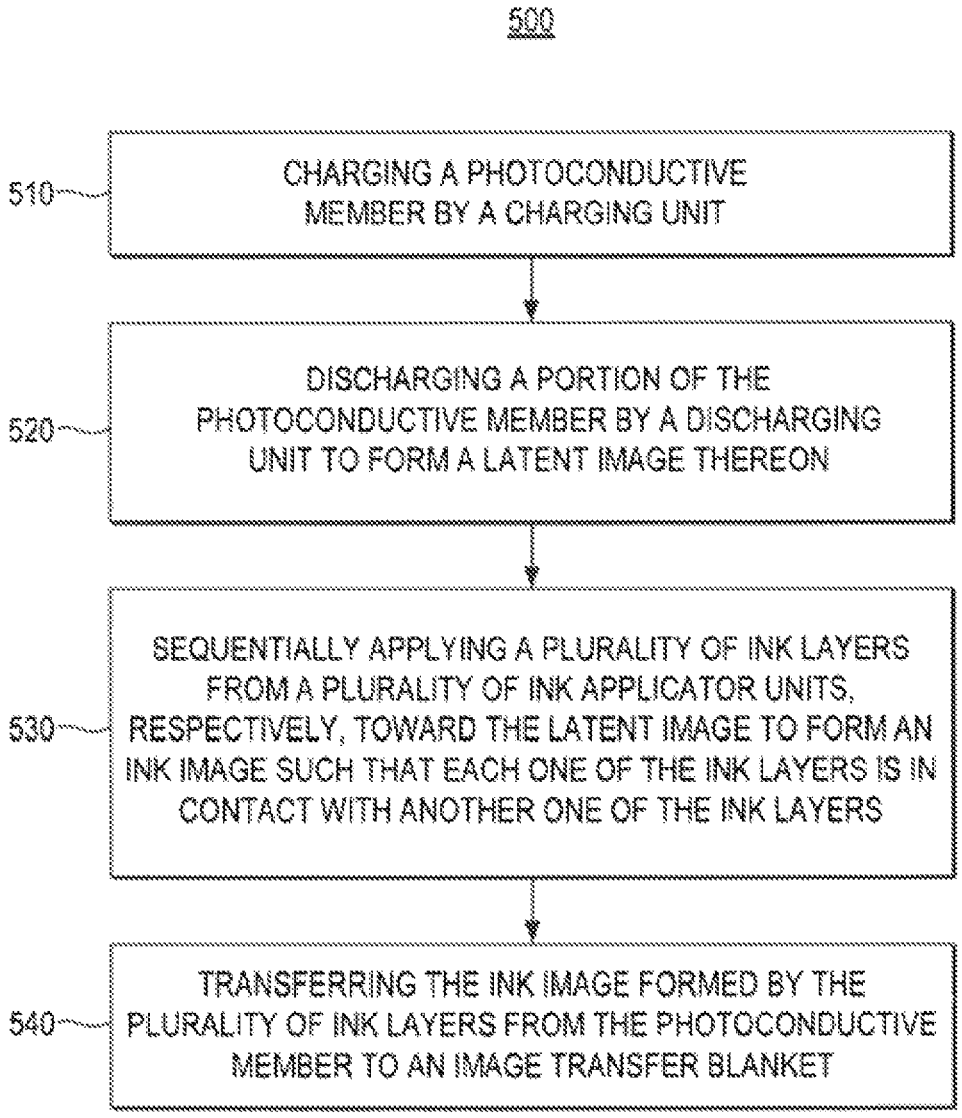
FIG. 5 is a flowchart illustrating a method of operating an image forming apparatus according to an example.

FIG. 5 is a flowchart illustrating a method of operating an image forming apparatus according to an example. Referring to FIG. 5, in block S510, a photoconductive member is charged by a charging unit. In block S520, a portion of the photoconductive member is discharged by a discharging unit to form a latent image thereon. In block S530, a plurality of ink layers is sequentially applied from a plurality of ink applicator units, respectively, toward the latent image to form an ink image such that each one of the ink layers is in contact with another one of the ink layers. The plurality of ink layers may include a dual ink layer structure. For example, a first ink layer may be applied from a first ink applicator unit toward the latent image, and a second ink layer may be applied from a second ink applicator unit toward the latent image and on top of the first ink layer. In some examples, the plurality of ink layers may include more than dual ink layer structure. For example, the plurality of link layers may include a triple ink layer structure. That is, a third ink layer may be applied from a third ink applicator unit toward the latent image and on top of the second ink layer. Each one of the plurality of ink layers may include charge directors. In some examples, the first ink layer may include one of a primer layer and a colored-ink layer, and the second ink layer may include one of a colored-ink layer and an ink coating layer. In some examples, the third ink layer may include one of a colored-ink layer and an ink coating layer. For example, the ink coating layer may include a gloss coating layer, a matte coating layer, or the like. In block S540, the ink image formed by the plurality of ink layers is transferred from the photoconductive member to an image transfer blanket. The method may also include transferring the ink image from the image transfer blanket to a media.

Figure 6:
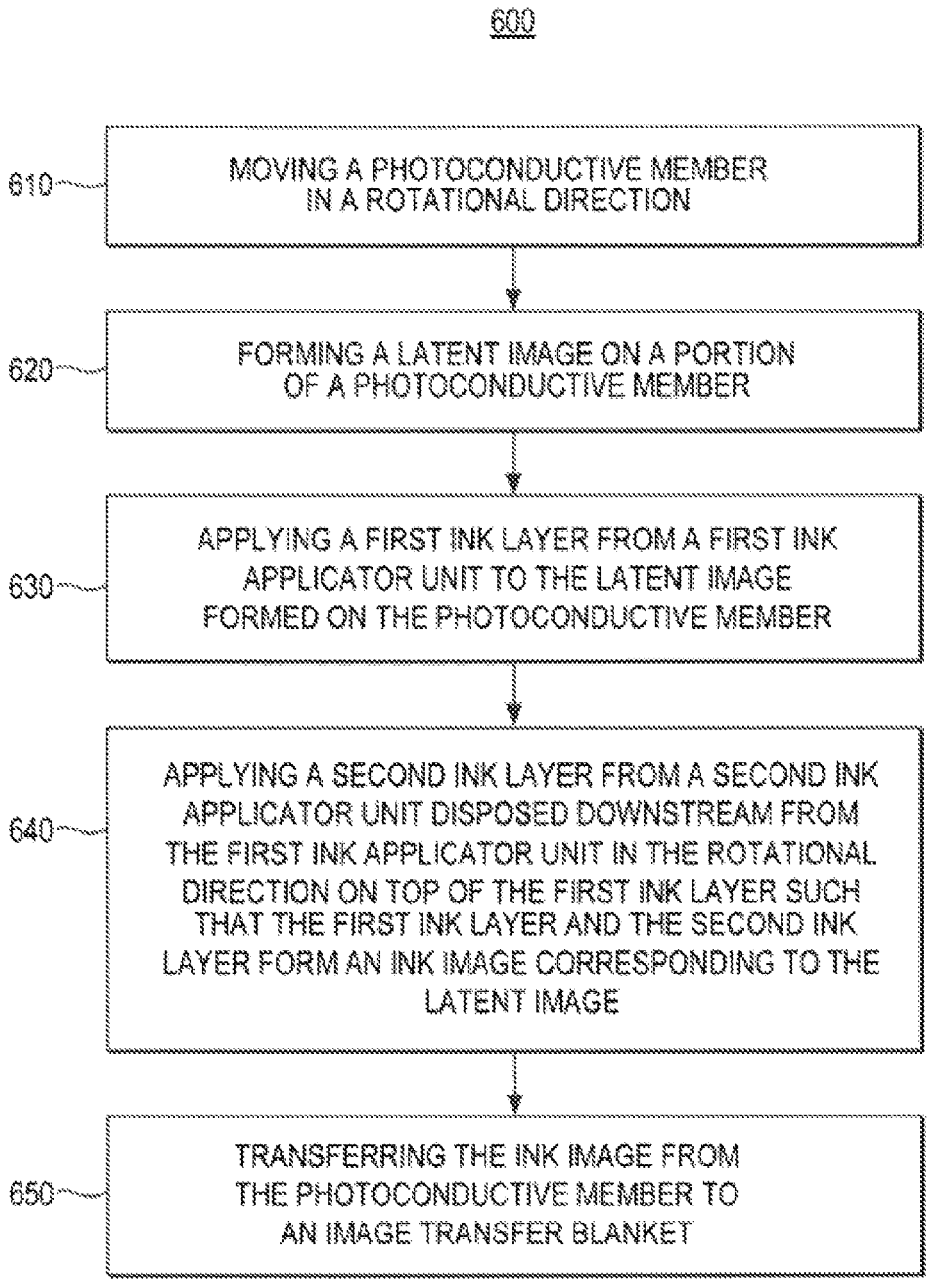
FIG. 6 is a flowchart illustrating an image forming method according to an example.

FIG. 6 is a flowchart illustrating an image forming method according to an example. Referring to FIG. 6, in block S610, a photoconductive member is moved in a rotational direction. In block S620, a latent image is formed on a portion of a photoconductive member. For example, the portion of the photoconductive member may be discharged by a discharging unit to form the latent image thereon. In block S630, a first ink layer is applied from a first ink applicator unit to the latent image formed on the photoconductive member. In block S640, a second ink layer is applied from a second ink applicator unit disposed downstream from the first ink applicator unit in the rotational direction on top of the first ink layer. The first ink layer and the second ink layer may form an ink image corresponding to the latent image. In some examples, a third ink layer may be applied from a third ink applicator unit disposed downstream from the second ink applicator unit in the rotational direction on top of the second ink layer. Accordingly, the first ink layer, the second ink layer, and the third ink layer may form the ink image corresponding to the latent image. In block S650, the ink image is transferred from the photoconductive member to an image transfer blanket. In some examples, the image forming method may also include charging a photoconductive member by a charging unit and transferring the ink image from the image transfer blanket to a media.

It is to be understood that the flowcharts of FIGS. 5 and 6 illustrate an architecture, functionality, and operation of an example of the present disclosure. If embodied in software, each block may represent a module, segment, or portion of code that includes one or more executable instructions to implement the specified logical function(s). If embodied in hardware, each block may represent a circuit or a number of interconnected circuits to implement the specified logical function(s). Although the flowcharts of FIGS. 5 and 6 illustrate a specific order of execution, the order of execution may differ from that which is depicted. For example, the order of execution of two or more blocks may be scrambled relative to the order illustrated. Also, two or more blocks illustrated in succession in FIGS. 5 and 6 may be executed concurrently or with partial concurrence. All such variations are within the scope of the present disclosure.

The present disclosure has been described using non-limiting detailed descriptions of examples thereof and is not intended to limit the scope of the present disclosure. It should be understood that features and/or operations described with respect to one example may be used with other examples and that not all examples of the present disclosure have all of the features and/or operations illustrated in a particular-figure or described with respect to one of the examples. Variations of examples described will occur to persons of the art. Furthermore, the terms "comprise," "include," "have" and their conjugates, shall mean, when used in the present disclosure and/or claims, "including but not necessarily limited to."

It is noted that some of the above described examples may include structure, acts or details of structures and acts that may not be essential to the present disclosure and are intended to be exemplary. Structure and acts described herein are replaceable by equivalents, which perform the same function, even if the structure or acts are different, as known in the art. Therefore, the scope of the present disclosure is limited only by the elements and limitations as used in the claims.

What is claimed is:

1. An image forming apparatus, comprising:

a photoconductive member to move in a rotational direction;

a single charging unit to charge the photoconductive member;

a discharging unit to discharge a portion of the photoconductive member to form a latent image on the photoconductive member;

a plurality of ink applicator units disposed across from the photoconductive member and spaced apart from each other in the rotational direction, the ink applicator units to, in a print cycle corresponding to one rotation of the photoconductive member, sequentially apply a plurality of ink layers, respectively, toward the latent image to form an ink image such that each one of the ink layers is in contact with another one of the ink layers, wherein at least one of the plurality of ink applicator units is other than a developer unit, wherein the sequentially applying the plurality of ink layers in the print cycle is performed with just a single charging of the photoconductive member in the print cycle by the charging unit and a single discharging of the photoconductive member in the print cycle by the discharging unit; and an intermediate transfer member having an image transfer blanket to receive the ink image including the plurality of ink layers from the photoconductive member.

2. The image forming apparatus according to claim 1, wherein the plurality of ink applicator units comprise:

a first ink applicator unit to apply a first ink layer toward the latent image; and a second ink applicator unit disposed downstream from the first ink applicator unit in the rotational direction, the second ink applicator unit to apply a second ink layer toward the latent image and on top of the first ink layer.

3. The image forming apparatus according to claim 2, wherein the first ink layer includes a primer layer, and the second ink layer includes a colored-ink layer.

4. The image forming apparatus according to claim 3, wherein each ink layer of the plurality of ink layers includes charge directors.

5. The image forming apparatus of claim 1, wherein the plurality of ink applicator units comprise an inkjet printhead.

6. A method of operating an image forming apparatus, the method comprising:

in a print cycle corresponding to one rotation of a photoconductive member in the image forming apparatus:

charging the photoconductive member by a single charging unit;

discharging a portion of the photoconductive member by a single discharging unit to form a latent image on the photoconductive member;

following the discharging by the single discharging unit, sequentially applying a plurality of ink layers from a plurality of ink applicator units, respectively, toward the latent image to form an ink image such that each one of the ink layers is in contact with another one of the ink layers, wherein at least one of the plurality of ink applicator units is other than a developer unit; and transferring the ink image formed by the plurality of ink layers from the photoconductive member to an image transfer blanket.

7. The method according to claim 6, wherein each ink layer of the plurality of ink layers comprises charge directors.

8. The method according to claim 6, wherein the sequentially applying the plurality of ink layers from the plurality of ink applicator units, respectively, toward the latent image to form the ink image comprises:

applying a first ink layer from a first ink applicator unit toward the latent image; and applying a second ink layer from a second ink applicator unit toward the latent image and on top of the first ink layer.

9. The method according to claim 8, wherein the first ink layer comprises a primer layer, and the second ink layer comprises a colored-ink layer having a color.

10. The method according to claim 9, wherein the sequentially applying the plurality of ink layers from the plurality of ink applicator units, respectively, toward the latent image to form the ink image further comprises:

applying a third ink layer from a third ink applicator unit toward the latent image and over the second ink layer, the third ink layer comprising an ink coating layer.

11. The method according to claim 6, further comprising:

transferring the ink image from the image transfer blanket to a media.

12. The method of claim 6, wherein the plurality of ink applicator units comprise an inkjet printhead.

13. An image forming method, comprising:

rotating a photoconductive member in a rotational direction in a print cycle corresponding to one rotation of the photoconductor member;

in the print cycle:

activating a single charging unit to charge the photoconductive member;

activating a discharging unit to discharge the photoconductive member, the discharging of the photoconductive member forming a latent image on a portion of the photoconductive member;

applying a first ink layer from a first ink applicator unit to the latent image formed on the photoconductive member;

applying a second ink layer from a second ink applicator unit disposed downstream from the first ink applicator unit in the rotational direction on top of the first ink layer such that the first ink layer and the second ink layer form an ink image corresponding to the latent image, wherein the first ink layer and the second ink layer are applied with just a single charging of the photoconductive member by the charging unit and a single discharging of the photoconductive member by the discharging unit, wherein the applying the first ink layer and the applying the second ink layer are part of sequentially applying ink layers by a plurality of ink applicator units, wherein at least one of the plurality of ink applicator units is other than a developer unit; and transferring the ink image from the photoconductive member to an image transfer blanket.

14. The image forming method according to claim 13, wherein the first ink layer comprises a primer layer, and the second ink layer comprises a colored-ink layer having a color.

15. The image forming method according to claim 13, further comprising:

in the print cycle, applying a third ink layer from a third ink applicator unit disposed downstream from the second ink applicator unit in the rotational direction on top of the second ink layer such that the first ink layer, the second ink layer, and the third ink layer form the ink image corresponding to the latent image.

16. The image forming method according to claim 13, further comprising:

transferring the ink image from the image transfer blanket to a media.

17. The image forming method of claim 13, wherein the second ink applicator unit comprises an inkjet printhead.

* * * * *